US007047641B2

(12) United States Patent
Hardesty et al.

(10) Patent No.: US 7,047,641 B2
(45) Date of Patent: May 23, 2006

(54) EXHAUST EMISSION CONTROL DEVICE MANUFACTURING METHOD

(75) Inventors: Jeffrey B. Hardesty, Byron, MI (US); Paul E. Jankowski, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 7 days.

(21) Appl. No.: 10/267,318

(22) Filed: Oct. 8, 2002

(65) Prior Publication Data

US 2003/0140495 A1 Jul. 31, 2003

Related U.S. Application Data

(63) Continuation-in-part of application No. 10/062,975, filed on Jan. 31, 2002, now abandoned.

(51) Int. Cl.
*B23P 17/00* (2006.01)

(52) U.S. Cl. ..... 29/890.08; 29/445

(58) Field of Classification Search ..... 29/890, 29/890.08, 805, 445, 447, 515, 516, 511, 29/464, 527.2; 422/179, 177, 176, 180, 181; 60/299; 72/370.13, 370.25, 370.02, 370.24, 72/84, 85, 112

See application file for complete search history.

(56) References Cited

U.S. PATENT DOCUMENTS 3,938,232 A * 2/1976 Noda et al. ..... 29/890
5,096,111 A 3/1992 Ishikawa et al.
5,332,609 A 7/1994 Corn
5,787,584 A 8/1998 Shea et al.
5,909,916 A * 6/1999 Foster et al. ..... 29/890
5,960,529 A 10/1999 Haesemann et al.
6,158,120 A 12/2000 Foster et al.
6,159,430 A 12/2000 Foster et al.
6,338,827 B1 1/2002 Nelson
6,354,903 B1 3/2002 Nelson
6,361,821 B1 3/2002 Anderson et al.
6,391,822 B1 5/2002 Dou et al.
6,438,839 B1 8/2002 Hardesty et al.
6,455,463 B1 9/2002 Labarge et al.
6,464,945 B1 10/2002 Hemingway
6,464,947 B1 10/2002 Balland
6,497,847 B1 12/2002 Foster et al.
6,532,659 B1 3/2003 DeSousa et al.
6,591,497 B1 7/2003 Foster et al. ..... 29/890
6,605,259 B1 8/2003 Henry
6,623,704 B1 9/2003 Roth
6,624,113 B1 9/2003 Labarge et al.
6,643,928 B1 11/2003 Hardesty et al.

* cited by examiner

*Primary Examiner*—T. Nguyen
(74) *Attorney, Agent, or Firm*—Paul L. Marshall

(57) ABSTRACT

An exhaust emission control device is manufactured by sizing a housing of over a substrate and intumescent mat subsequently to heating said emission control device. The step of heating causes said intumescent mat to at least reach a temperature at which it swells. If the substrate has a washcoat layer, it may be left unfired until after it is assembled with the housing, in which case the step of heating causes the washcoat layer to sinter.

19 Claims, 3 Drawing Sheets

EXHAUST EMISSION CONTROL DEVICE MANUFACTURING METHOD

CROSS REFERENCE TO RELATED APPLICATION

This application is a continuation-in-part of U.S. patent application Ser. No. 10/062,975 filed Jan. 31, 2002 by Jeffrey B. Hardesty, now abandoned and wholly incorporated herein by reference.

BACKGROUND

The present disclosure relates generally to exhaust emission control devices such as automotive catalytic converters. More particularly, the disclosure relates to a method of manufacturing emission control devices having fragile substrates.

Exhaust emission control devices comprise catalytic converters, evaporative emissions devices, scrubbing devices (e.g., hydrocarbon, sulfur, and the like), particulate filters/traps, adsorbers/absorbers, as well as combinations comprising at least one of the foregoing devices. This disclosure relates to such emission control devices having a ceramic substrate disposed within a metal housing with a matting material disposed between the substrate and housing. Although the substrate can have any size or geometry, the size and geometry are preferably chosen to optimize surface area in the given converter design parameters. Typically, the substrate has a honeycomb geometry, with the combs through-channel having any multi-sided or rounded shape, with substantially square, triangular, pentagonal, hexagonal, heptagonal, or octagonal or similar geometries preferred due to case of manufacturing and increased surface area. Although converter housings are most often cylindrical, they can be other shapes as well, such as having elliptical, oval, polygonal, and other cross sections.

In cases where a chemical washcoat is applied to the substrate, for example, a catalyst material and/or an adsorption material washcoat layer, the materials are wash coated, imbibed, impregnated, physisorbed, chemisorbed, precipitated, or otherwise applied to the catalyst substrate. In addition, a binder and/or support material such as aluminum oxide can be mixed with the chemical washcoat according to the specification of the particular application. Once the washcoat is applied to the substrate, the substrate is fired at a high temperature to sinter the washcoat thereby forming a hard phase of the chemical coating. It has previously been known to fire the washcoat prior to assembling the substrate into the emission control device housing.

Newer "thin-wall" substrates used in exhaust emission control devices offer significant advantages over traditional substrates, including a greater geometric surface area per unit volume and faster catalyst light-off due to the lower thermal mass of the substrate. As is generally understood in the art, faster light-off translates to higher conversion efficiency since catalytic converters are not effective during a cold engine start until they reach operation, or light-off temperature. However, thin wall substrates are significantly more fragile and are subject to fracture during stressful manufacturing operations that including stuffing, sizing, and burnoff operations.

One method currently employed to manufacture an emission control devices include wrapping the substrate in a retention material, or mat, and stuffing the substrate and mat into a metal housing through the use of a stuffing cone, the cone serving to compress the matting so that it can slide into the housing (see FIG. 2). The retention material enhances the structural integrity of the substrate by applying compressive radial forces about it, reducing its axial movement and retaining it in place. Typically, the retention material is concentrically disposed around the substrate to form a retention material/substrate subassembly.

Another method involves disposing particulate retention material between the substrate and the housing. While the retention material can be in the form of a mat, particulates, or the like, it will be referred to herein simply as "mat" and it will be understood that the term "mat" as used herein refers to the retention material regardless of what form it is in.

Depending on the type of mat, whether it is intumescent or non-intumescent, the necessary stuffing pressure varies. Intumescent mats are called such because they swell under high temperature. This swelling is a property of a component of the mat, typically vermiculite. Non-intumescent mats do not contain vermiculite. These materials can comprise ceramic materials and other materials such as organic binders and the like, or combinations comprising at least one of the foregoing materials. Non-intumescent materials include materials such as those sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Intumescent materials include materials sold under the trademark "INTERAM" by the "3M" Company, Minneapolis, Minn., as well as those intumescents which are also sold under the aforementioned "FIBERFRAX" trademark, as well as combinations thereof and others.

The swelling property of intumescent mats is useful because it helps to maintain a positive pressure between the substrate and the housing during the thermal cycle imposed on the converter in normal use without having to greatly compress the mat during manufacture. In use, the diameter of the metal housing increases due to thermal expansion to a greater degree than that of the ceramic substrate. Thus, to maintain a positive pressure, a mat must expand to fill the growing gap as the temperature rises. Non-intumescent mats must be stuffed under much greater force to a high level of compression in order to ensure a continued positive pressure between the substrate and housing during use. This high-force stuffing is more time consuming and takes considerable energy, which significantly increases the overall production cost of the converter.

Once the substrate and matting material is stuffed into the housing, the housing may be sized and appropriate connections are formed for assembly into an exhaust system. Sizing operations, when necessary, compensate for variations in substrate diameters, and may comprise compressing the housing to produce an overlapped seam, and then welding, or a housing may be reduced by drawing or compressing the housing using a pipe-sizer.

Exhaust pipe connections may be formed in or welded onto either end of the housing. The ends of the shell may be sized, e.g., using a spinform method, to form a conical shaped inlet and/or a conical shaped outlet, thus eliminating the need for separate endcone assemblies in at least one embodiment of the exhaust emission control device. In the alternative, one or both ends of the shell can also be sized so that an end cone, an end plate, an exhaust gas manifold assembly, or other exhaust system component, and combinations comprising at least one of the foregoing components, can be attached to provide a gas tight seal. Thus, the connections include portions having varying cross-sections to conform the stream entering the converter to the shape of the substrate, thereby allowing exhaust to flow from the engine into and out of the converter, and through the remaining exhaust system to the tail pipe.

After the exhaust pipe connections are formed on the housing, the emission control device is ready to be assembled into an engine. During the converter's first use, the converter is heated to normal operating temperature, which may be anywhere from 300° C. to more than 500° C. This first use or heating drives off organic binders within the mat and causes the intumescent material within the mat to greatly expand, thus increasing the pressure within the confines between the housing and substrate. Some substrates, particularly the newer, more fragile substrates, can fail under this pressure, rendering the entire converter unusable.

For comparision, a graph showing estimated matting pressure as a function of type of operation during the prior art manufacturing method described above is provided in FIG. 6. Starting at the left side of the graph, the intumescent matting is stuffed under very low pressure, i.e., less than 10 pounds per square inch (psi). The pressure is greatly increased to about 150 psi during the sizing operation. After sizing, the matting responds by relaxing somewhat, reducing the stress therein and the pressure to about 100 psi. Finally, the converter is heated, e.g., during its first use, which causes swelling of the matting, which increases the pressure by about 80 psi to 180 psi. The pressure may be even higher locally within the matting material due to variations in the matting or the substrate itself. The fragile ceramic substrate is sometimes unable to stand up to these high pressures and fails.

It would be desirable to reduce the likelihood of breaking the ceramic substrate during the production or first use of a catalytic converter.

SUMMARY

Disclosed herein is a method including sizing a housing of an exhaust emission control device over a substrate and intumescent mat subsequently to heating the emission control device, the heating causing the intumescent mat to at least reach a temperature at which the intumescent mat swells. If the substrate has a washcoat layer, it may be left unfired until after it is assembled with the housing, the heat step serving to fire and sinter the washcoat layer.

The above-discussed and other features will be appreciated and understood by those skilled in the art from the following detailed description and drawings.

DETAILED DESCRIPTION

Figure 1:
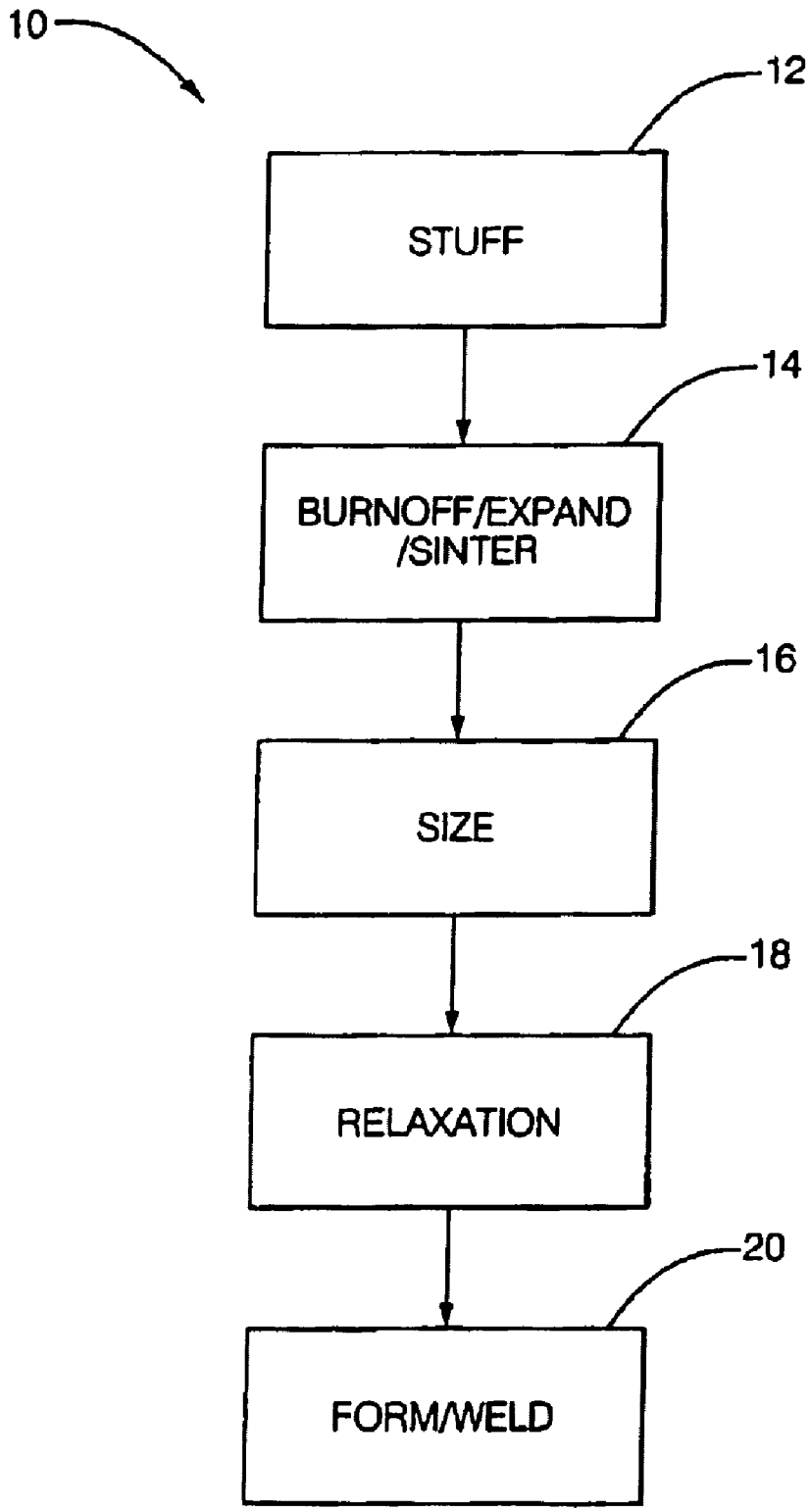
FIG. 1 shows a flow chart illustrating a method to produce a catalytic converter.

A flow chart diagramming a method for manufacturing a catalytic converter is shown in FIG. 1. The method will be described to some extent by reference to FIGS. 2, 3, and 4. It has been found that by heating the material prior to sizing reduces the internal matting pressure against the fragile substrate and therefore reduces the likelihood of breakage thereof.

Figure 2:
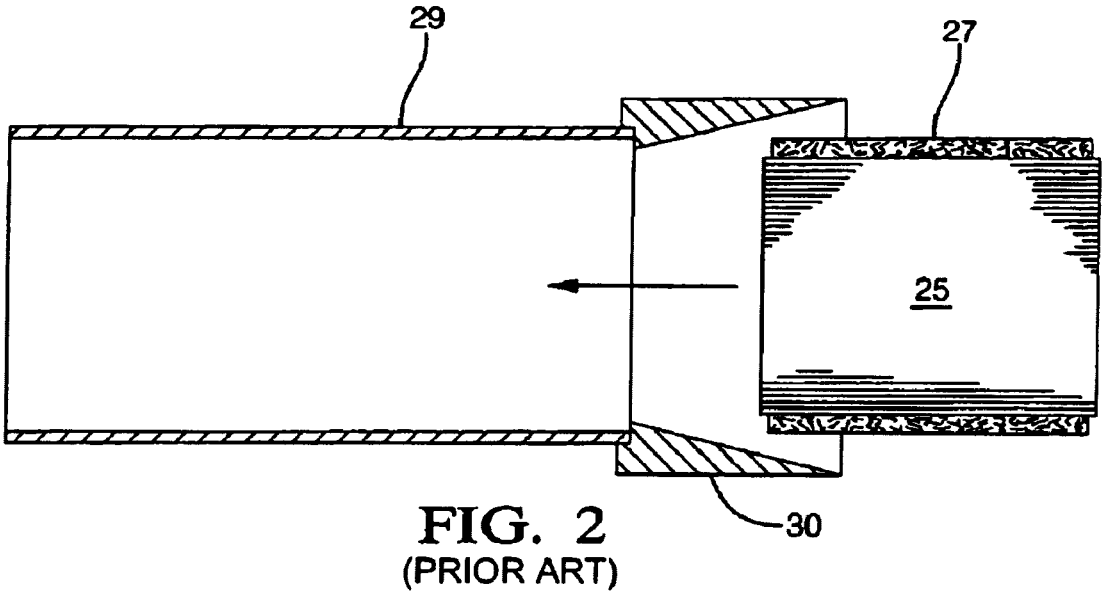
FIG. 2 (PRIOR ART)
FIG. 2 shows a first step in the construction of a catalytic converter, according to a prior art method.

Thus, in the preferred process, in a first step 12, intumescent matting 27 is wrapped around a substrate 25, and the substrate 25 with matting 27 is stuffed into a housing 29. If the substrate has a washcoat, it is left unfired prior to assembly. The stuffing operation is ordinarily conducted through the use of a stuffing cone 30, as shown in FIG. 2. The stuffing cone compresses matting 27 to a diameter the same as or slightly smaller than the smallest potential diameter of housing 29, according to manufacturing tolerances, thus allowing matting 27 and substrate 25 to slide into place within housing 29.

The stuffing operation is done under low pressure, and low mount Gap Bulk Density (GBD). The GBD defines the level of mat compression in grams per cubic centimeter ($g/cm^3$). The preferred mount density for the stuffing operation is less than or equal to about 0.7 $g/cm^3$. It is also preferred that the mount density be greater than or equal to about 0.6 $g/cm^3$.

Figure 3:
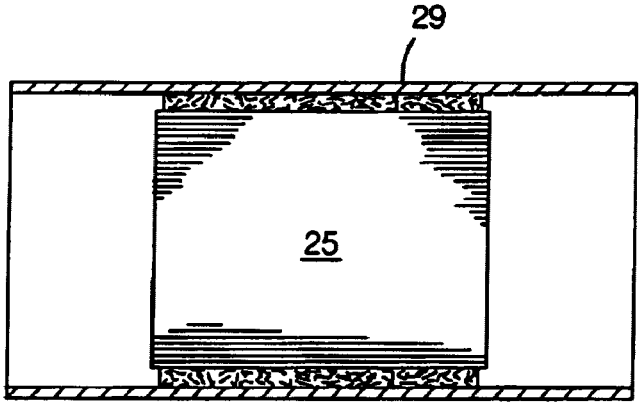
FIG. 3 shows a subsequent step in the construction of a catalytic converter, according to one embodiment of the disclosed method.

After stuffing, substrate 25 and matting 27 are positioned within housing 29 as shown in FIG. 3, and the assembly is heated in an oven to undergo burn-off and expand step 14 (FIG. 1). It is preferred that the assembly be heated to a temperature greater than or about 500 degrees Celsius. The heating can comprise heating the converter to a maximum temperature less than or equal to about 600° C. Durig this step, organic binders are burned off and the vermiculite or other intumescent component of matting 27 swells. If the substrate has a washcoat, this burn-off and expand step also serves to fire the washcoat, thus seperately firing the washcoat is unnecessary.

Following burn-off/expand step 14, housing 29 is sized by step 16 to bring the GBD to approximately 1.0 $g/cm^3$. The target size for each housing may vary depending upon the size of the substrate. Alternatively, the target size may be a dimension that is common for all converters being manufactured that is optimally determined to satisfy GBD requirements within reasonable tolerances.

There are several known methods for sizing housing 29. A preferred sizing technique is described in commonly-assigned U.S. patent application Ser. No. 09/141,299, filed Aug. 27, 1998 by Michael R. Foster, et al., which is incorporated herein by reference in its entirety. In this method, each substrate 25 is individually measured to determine its dimensions prior to stuffing into a housing that does not have any slits. The housing is then sized by compressing it from all directions in a radial press, thereby plastically deforming the housing until it reaches the target size. Such sizing devices are generally known for expanding and diametrically compressing pipes.

Another method that can be used, sometimes referred to as a tourniquet or shoebox method, is best for cylindrical housings having one or two slits and includes compressing or tightening the housing, e.g., with a strap or press, until the proper size is reached or the compressing force reaches a selected stop force, then welding the seem or seams. Housing 29 is reduced in size until the target size is reached or a selected stop-force sensed by the sizing machine. In this manner, sizing step may compensate for variations in the size of the substrate.

Figure 4:
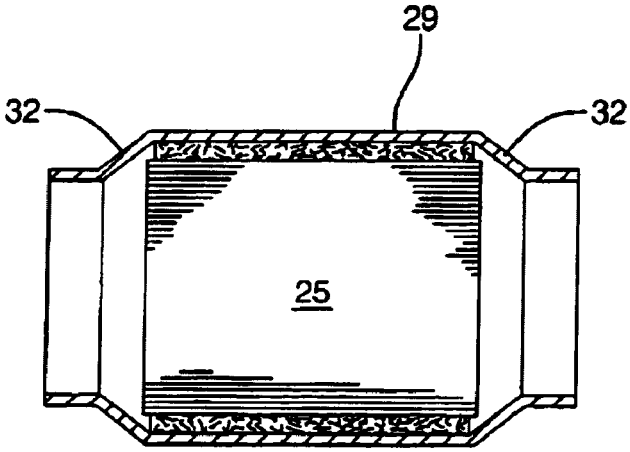
FIG. 4 shows a subsequent step in the construction of a catalytic converter, according to one embodiment of the disclosed method.

After the sizing step 16, mat 27 undergoes a relaxation step 18 in which the mat material partially relaxes, reducing the internal pressure. Finally, the connection ends 32 are added to housing 29 by form/weld step 20. After the sizing step 16, the mat can be allowed to relax concurrently with adding connection ends to the housing. Form/weld step 20 may comprise any known method of forming connection ends onto housing 29, either by welding them to the housing 29 or by deforming housing 29 to shape the connection ends. In one preferred embodiment, housing 29 extends some distance on either side of substrate 25 as shown in FIG. 3, and undergoes a spin-form process in which rollers progressively shape either end until connection ends 32 are formed as seen in FIG. 4.

EXAMPLE

Figure 5:
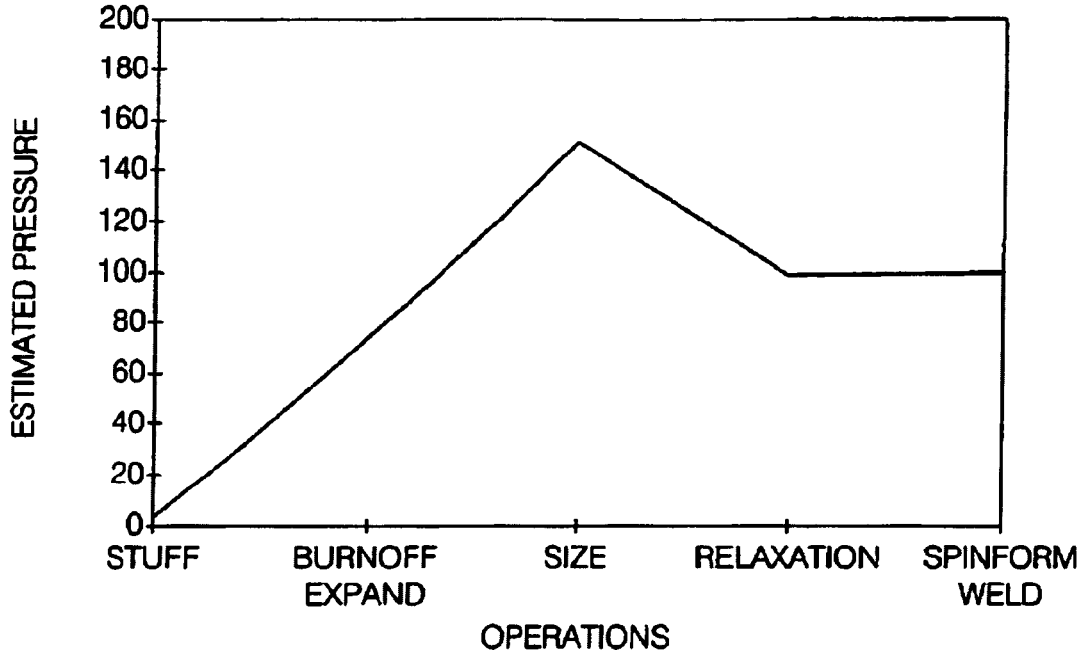
FIG. 5 shows a pressure-time diagram illustrating the advantages of the method shown in FIG. 1.
Figure 6:
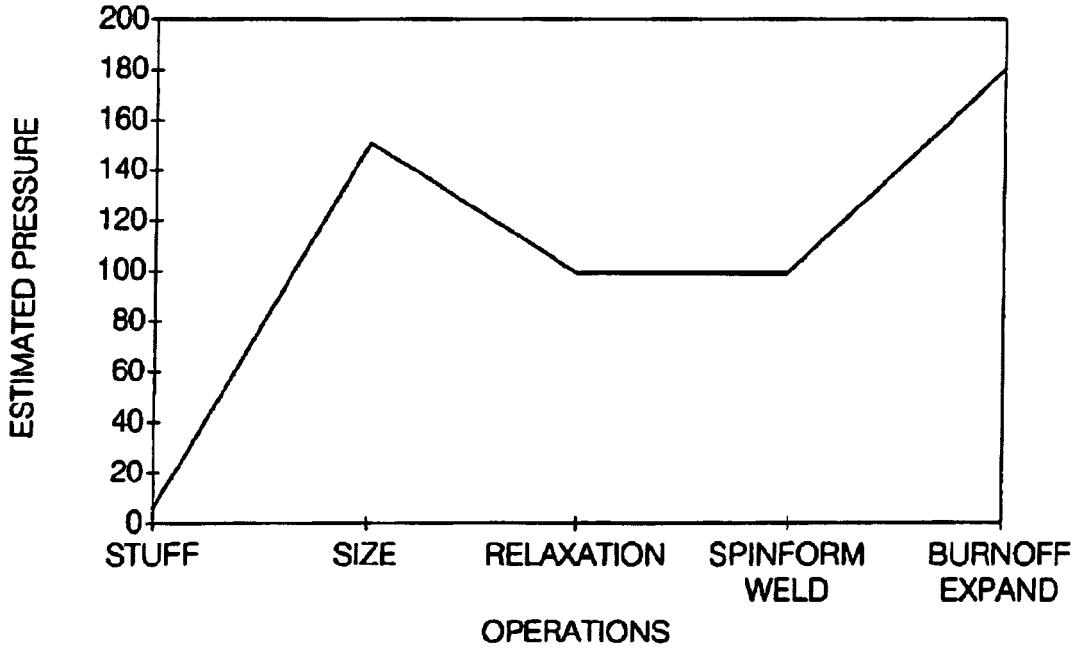
FIG. 6 (PRIOR ART)
FIG. 6 shows, for comparison, a diagram showing estimated matting pressure as a function of type of operation, and illustrating the disadvantage of a prior art method.

FIG. 5 shows a diagram showing estimated pressure changes in an example according to the method described above. Initial mounting pressure is shown at the left side of the diagram to be less than 10 psi. Burn-off/expansion increases the pressure to about 80 psi. Subsequent to the burn-off expand step 14, pressure increases again during sizing step 16, during which internal mat pressure increases to about 150 psi. This same pressure is attained in the method shown in FIG. 6 because, as noted above, the internal pressure subsequent to the sizing operation is dependent upon the GBD of the mat. Relaxation step 18 reduces internal pressure by about 50 psi to about 100 psi. Since matting 27 has already been expanded in expansion step 14, subsequent heating in use of the device will not increase the pressure within the mat to such a degree that substrate 25 is likely to fail.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

We claim:

1. A method of manufacturing exhaust emission control device comprising the steps of:

placing an intumescent mat around a substrate;

positioning said intumescent mat and substrate inside a housing of said emission control device;

expanding said intumescent mat inside said housing with heat; and then reducing the size of said housing.

2. The method of claim 1, wherein said placing step comprises wrapping said substrate with said mat, forming a wrapped substrate; and said positioning step comprises stuffing said wrapped substrate into said housing.

3. The method of claim 2 wherein said stuffing increases a gap bulk density to a mount density less than about 0.7 g/cm$^3$.

4. The method of claim 1 wherein said reducing step compresses said housing over said substrate to a gap bulk density of about 1.0 g/cm$^3$.

5. The method of claim 1 further comprising allowing said mat to relax subsequent to said reducing step.

6. The method of claim 1 further comprising adding connection ends on said housing subsequent to said reducing step, said adding comprising one of forming and welding said connection ends.

7. The method of claim 1 further comprising allowing said mat to relax subsequent to said reducing step, and adding connection ends on said housing subsequent to said reducing step.

8. The method of claim 7 wherein said allowing and said adding occur concurrently.

9. The method of claim 7 wherein said adding comprises plastically deforming said housing to form one of said connection ends.

10. The method of claim 7 wherein said adding comprises welding one of said connection ends onto said housing.

11. The method of claim 1 further comprising:

wrapping said substrate with said mat, forming a wrapped substrate;

stuffing said wrapped substrate into said housing prior to said expanding step;

allowing said mat to relax subsequent to said reducing step; and adding connection ends on said housing subsequent to said reducing step by one of forming and welding said connection ends.

12. The method of claim 11 wherein said stuffing increases a gap bulk density to a mount density no more than about 0.7 g/cm$^3$.

13. The method of claim 12 wherein said expanding step comprises heating said emission control device to at least about 500° C.

14. The method of claim 1 wherein said expanding step comprises heating said emission control device to at least about 500° C.

15. The method of claim 14 wherein said expanding step comprises heating said emission control device to a maximum temperature equal to or less than about 600° C.

16. The method of claim 1 wherein said substrate comprises an un-fired washcoat layer prior to said heating, said expanding with heat step serves to fire and sinter said washcoat layer.

17. A method of manufacturing an exhaust emission control device comprising:

disposing a substrate and surrounding mat in a housing, the substrate having a washcoat layer;

sintering said washcoat layer subsequently to said disposing; and sizing the housing of said emission control device over said substrate and said mat subsequent to said sintering said washcoat layer.

18. The method of claim 17 further comprising:

allowing said mat to relax subsequent to said sizing; and adding connection ends on said housing subsequent to said sizing by one of forming and welding said connection ends.

19. The method of claim 17 further comprising adding connection ends on said housing by one of forming and welding said connection ends.

* * * * *